US006883675B2

(12) United States Patent
Maenke

(10) Patent No.: US 6,883,675 B2
(45) Date of Patent: Apr. 26, 2005

(54) DRUM VENT

(75) Inventor: Dale Maenke, Chaska, MN (US)

(73) Assignee: Entegris, Inc., Chaska, MN (US)

( * ) Notice: Subject to any disclaimer, the term of this patent is extended or adjusted under 35 U.S.C. 154(b) by 0 days.

(21) Appl. No.: 10/696,574

(22) Filed: Oct. 29, 2003

(65) Prior Publication Data

US 2004/0118845 A1 Jun. 24, 2004

Related U.S. Application Data

(60) Provisional application No. 60/422,433, filed on Oct. 30, 2002.

(51) Int. Cl.[7] ..... B65D 51/16

(52) U.S. Cl. ..... 220/203.11; 220/203.13; 220/367.1; 220/371; 220/601

(58) Field of Search ..... 220/203.13–203.18, 220/203.11, 601, 303, 367.1, 369–373; 215/307–310, 261

(56) References Cited

U.S. PATENT DOCUMENTS

| | | | | | |
|---|---|---|---|---|---|
| 3,448,882 | A | | 6/1969 | Roy | |
| 3,951,293 | A | | 4/1976 | Schulz | |
| 4,136,796 | A | * | 1/1979 | Dubois et al. | 220/371 |
| 4,765,499 | A | * | 8/1988 | von Reis et al. | 220/371 |
| 4,902,423 | A | | 2/1990 | Bacino | |
| 5,096,473 | A | | 3/1992 | Sassa et al. | |
| 5,353,949 | A | * | 10/1994 | Seibert et al. | 220/371 |
| 5,908,129 | A | * | 6/1999 | Schutz | 220/203.11 |
| 5,988,414 | A | * | 11/1999 | Schwarz et al. | 215/308 |
| 6,045,000 | A | * | 4/2000 | Rauworth et al. | 220/601 |
| 6,079,597 | A | * | 6/2000 | Rauworth et al. | 222/400.7 |
| 6,193,088 | B1 | * | 2/2001 | Vincent et al. | 215/308 |
| 6,368,741 | B1 | * | 4/2002 | Hackel et al. | 429/53 |

FOREIGN PATENT DOCUMENTS

| | | | |
|---|---|---|---|
| WO | 98/13273 | * | 4/1998 |

* cited by examiner

*Primary Examiner*—Nathan J. Newhouse
(74) *Attorney, Agent, or Firm*—Patterson, Thuente, Skaar & Christensen, P.A.

(57) ABSTRACT

A venting device for a drum. The venting device includes a body having a pair of opposing sides and defining a plurality of vent passages. The vent passages extend through the body and each an opening at each of the pair of opposing sides. The vent passages are spaced apart and arranged around a center portion of the body. A membrane structure is positioned so as to cover the openings of the vent passages on one of the pair of opposing sides of the body. The membrane structure is sealingly affixed to the body portion in a sealing band surrounding the openings of the vent passages. A portion of the membrane structure is further affixed to the center portion of the body. A protective structure may be attached to the body and positioned over the membrane structure.

20 Claims, 3 Drawing Sheets

DRUM VENT

RELATED APPLICATIONS

This application claims the benefit of U.S. Provisional Patent Application Ser. No. 60/422,433 entitled "Vent Plug", filed Oct. 30, 2002, hereby fully incorporated herein by reference.

FIELD OF THE INVENTION

The present invention is directed to venting of drums, and more particularly to a venting device for a drum.

BACKGROUND OF THE INVENTION

Drums, barrels and other containers are widely used to store, transport and dispense chemicals and industrial fluids. An example of such a drum is disclosed in U.S. Pat. No. 6,045,000, which is owned by the owners of the present invention and is hereby fully incorporated herein by reference. In some industries, such as semiconductor processing, the liquids contained may be highly volatile and may evolve vapors or gases that will build pressure within the container unless vented. An example of such a fluid is hydrogen peroxide, which will evolve oxygen. Also, like hydrogen peroxide, the fluids may be toxic, flammable or otherwise hazardous. Thus, it is important that the fluid be contained within the drum and not allowed to escape. In addition, the contained fluids must often be maintained in an extremely pure condition, and any outside contaminants must be prevented from entering the container through vents or other openings. An example of a containment system and dispense head incorporating many of these features is disclosed in U.S. Pat. No. 6,079,597, also hereby fully incorporated herein by reference.

Drums and closure devices, including vents, used for shipping hazardous chemicals, such as many of the chemicals used in semiconductor processing, must pass rigorous tests required by the U.S. Department of Transportation for transport within the United States and the United Nations for transport internationally. One of these tests, required by 49 C.F.R. § 178.603 (2001), requires that the drum be inverted dropped. The drum must maintain its structural integrity and no part must leak fluid after the test.

During the drop test described above, a venting device can experience a sharp pressure reversal. When the drum first makes impact with the ground, the drum deflects, compressing the fluid inside and exerting a liquid pressure on the vent from inside the drum. Next, however, when the drum may resiliently spring back and the liquid moves back away from the vent, air will be drawn through the vent in the opposite direction.

Various devices have been developed for venting drums and other containers so as to allow evolved vapor and gases to escape while preventing the escape of liquid and the entry of contaminants. One such prior device includes a threaded plastic plug portion with one or more apertures in the center of the plug. A membrane is affixed over the apertures and is fastened to the plug at the margins. The plug is threaded into a corresponding threaded opening in the top of the drum with the membrane facing inward into the drum. The membrane is generally a piece of PTFE material on a backing scrim material. The membrane and scrim has a thickness of from about 0.015 to 0.020 inch. The PTFE membrane allows gas and vapor molecules to escape through the apertures and through the pores of the membrane, while preventing the escape of liquid.

A problem with these prior devices is that, unless the membrane and scrim assembly is made relatively thick, the inrush of air through the vent occurring during the drop test as described above tends to rupture the membrane or tear it loose from the plug portion. In addition, the thick membrane material restricts flow through the vent, leading to diminished vent performance. The thick material can become clogged with dried chemicals, leading to eventual failure of the vent. Another problem is that the membrane is open to contact from foreign objects and may be easily damaged as a result.

Other prior art vents have been developed wherein protective structures are placed proximate the membrane so as to protect the membrane from contact. In these vents, however, chemicals can be retained in the protecting structure if the drum is not stored in an upright condition, and may coagulate or dry adjacent to the membrane. This leads to eventual failure of the venting device as described above.

Thinner membranes have been used in some prior art vents to improve venting effectiveness. These membranes can be as thin as 0.002 inch and may have pore sizes on the order of 0.2 microns. A protector plate structure is positioned on the inner side of the vent over, and slightly spaced apart from, the membrane. The protector plate serves two functions in this device. First, it provides protection from contact for the membrane, which is subject to damage from even light contact with any hard object due to its thinness. Secondly, it serves to restrain the membrane during the air inrush phase of drop testing, thereby preventing the membrane from rupturing. The protector plate may generally placed no more than about 0.030 inch away from the membrane without incurring a significant risk of rupture during drop testing.

A problem with the thinner membrane vents with protector plates, however, is that chemicals can "hang-up" in the protector plate structure and may accumulate around the membrane. These chemicals may coagulate or dry, leading to failure of the vent. Also, the relatively solid structure of the protector place, necessary to adequately protect and restrain the membrane, may result in a loss of venting capacity in some cases.

What is needed in the industry is a more effective and more durable venting device for a drum.

SUMMARY OF THE INVENTION

The present invention substantially meets the aforementioned needs of the industry. The invention includes a venting device adapted to be sealingly received in an opening of a drum. The venting device includes a body having a pair of opposing sides and defining a plurality of vent passages. The vent passages extend through the body and each an opening at each of the pair of opposing sides. The vent passages are spaced apart and arranged around a center portion of the body. A membrane structure is positioned so as to cover the openings of the vent passages on one of the pair of opposing sides of the body. The membrane structure is sealingly affixed to the body portion in a sealing band surrounding the openings of the vent passages. A portion of the membrane structure is further affixed to the center portion of the body. A protective structure may be attached to the body and positioned over the membrane structure.

The attachment of the membrane structure to the center portion of the body as well as at the sealing band surrounding the vent openings offers significant advantages over prior art devices, relative to strength and durability. First, the additional attachment contact area allows force applied to the membrane structure to be spread over a larger area. The result is reduced stress values at the sealing band during drop testing and other high load causing events. As a consequence, the likelihood that membrane assembly will be torn loose or ruptured during such events is reduced. Also, the resultant overall reduction in unsupported span of vent membrane assembly results in less deflection of the membrane during such conditions. The described structure also enables the use of generally thinner membrane structures with greater spacing between the membrane structure and any protective structure, thereby improving the effectiveness and performance of the venting device.

DETAILED DESCRIPTION OF THE PREFERRED EMBODIMENTS

Figure 1:
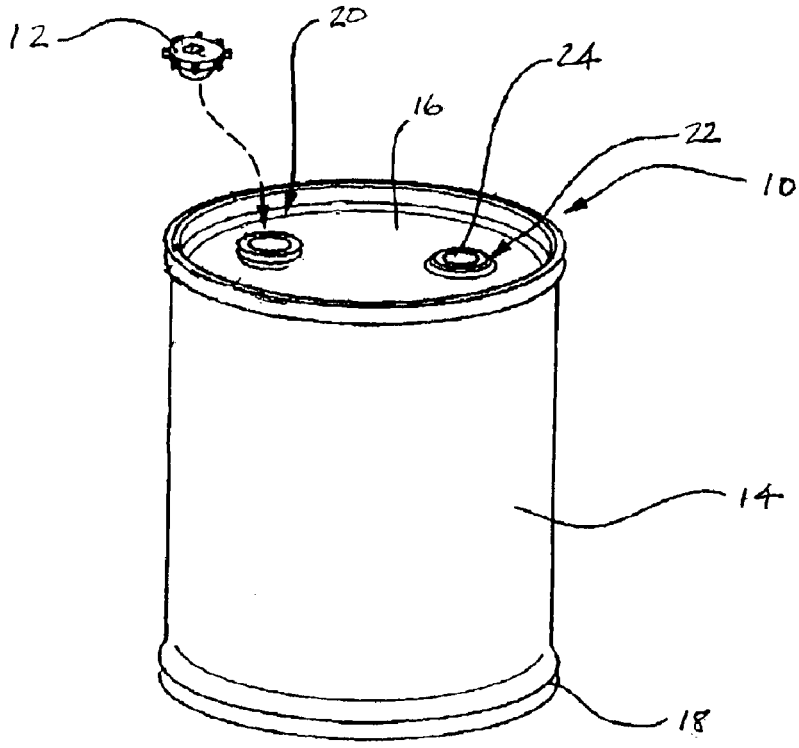
FIG. 1 is a perspective view of a drum according to the present invention.
Figure 2:
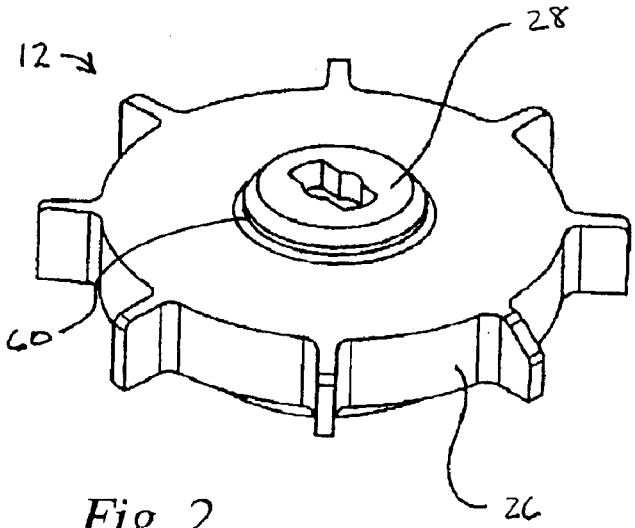
FIG. 2 is a perspective view of a vented closure with a venting device according to the present invention.

Referring to FIGS. 1 and 2, a drum 10 and vented closure 12 according to the present invention is depicted. FIG. 1 depicts in perspective a plastic blow molded drum 10 generally including a cylindrical wall portion 14, a top structure 16 and a bottom structure 18. Top structure 16 includes a first bunghole 20 and a second bunghole 22. Second bunghole is closed with a standard bung 24 which sealingly engages in second bunghole 22. Vented closure 12 sealingly engages in first bunghole 20. First and second bungholes 20, 22, generally have interior threads which threadedly and sealingly engage exterior threads on vented closure 12 and standard bung 24. It will be appreciated, however, that closure 12 and bung 24 may be engaged in bungholes 20, 22, by any alternative means as may be known to those of skill in the art.

Figure 3:
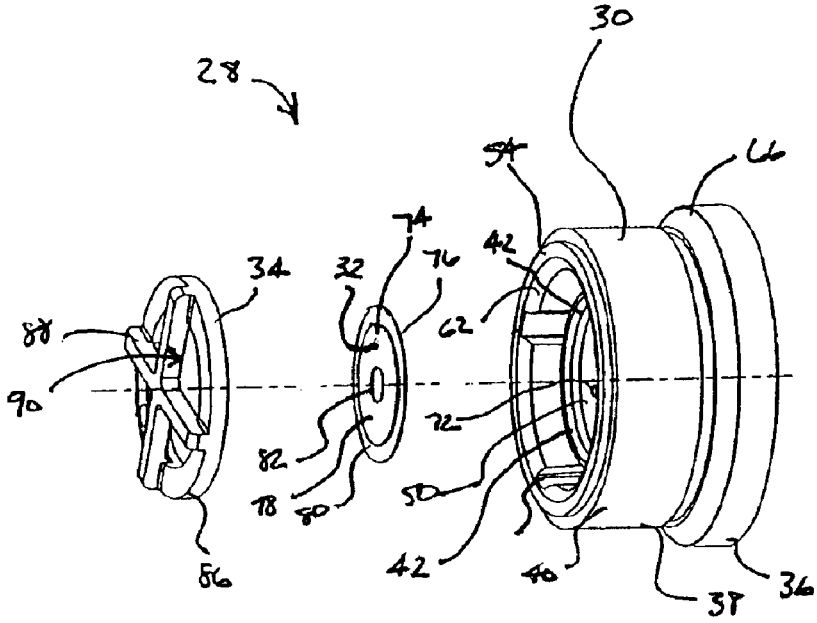
FIG. 3 is an exploded perspective view of a venting device according to the present invention from the side of the device facing the interior of the drum.

Vented closure 12 is depicted in perspective view in FIG. 2. Closure 12 generally includes bung portion 26 and venting device 28. Venting device 28, as depicted in FIG. 3, generally includes body 30, membrane structure 32 and protective structure 34.

Body 30, is preferably molded from suitable polymer material in a single piece. Body 30 generally includes head portion 36 and tail portion 38. Tail portion 38 generally includes outer shell portion 40, which surrounds an inner venting portion 42, defining annular space 44. Spacer ribs 46 are formed within annular space 44 and serve to stabilize and laterally support inner venting portion 42. Inner venting portion 42 has a plurality of vent passages 48 extending from inner side 50 and through inner venting portion 42 to exterior side 52 of venting device 28. Inner side 50 has a projecting annular ring structure 54 at its circumference, defining a recessed portion 56.

Outer shell portion 40 may have screw threads 58, enabling it to be threaded into a suitably threaded receiving port 60 in vented closure 12 or directly in the bunghole of a drum. Of course, other suitable methods may also be used to secure venting device 28 in an opening including adhesives, integral molding, heat staking, welding or any other attachment method whereby venting device 28 may be sealingly and firmly secured in the opening. Outer shell portion 40 may further have a recess 62 for receiving protective structure 34, as is further described hereinbelow.

Head portion 36 may have means, such as key slot 64, to enable venting device 28 to be threaded or otherwise inserted and secured in receiving port 60. Head portion 36 may also have projecting lip 66, which may serve as a stop for an operator to determine the proper insertion position for venting device 28.

Figure 7:
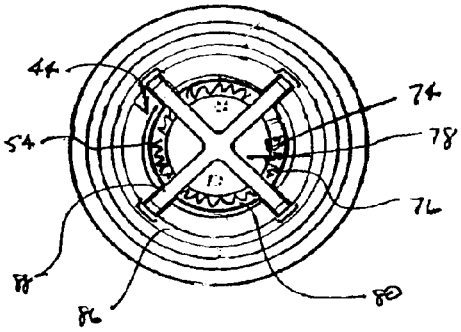
FIG. 7 is a plan view of the interior side of the venting device.
Figure 7A:
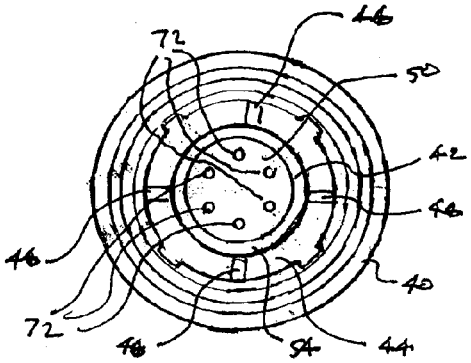
FIG. 7*a* is a plan view of the interior side of the body portion of the venting device with the membrane and protective structures removed.
Figure 8:
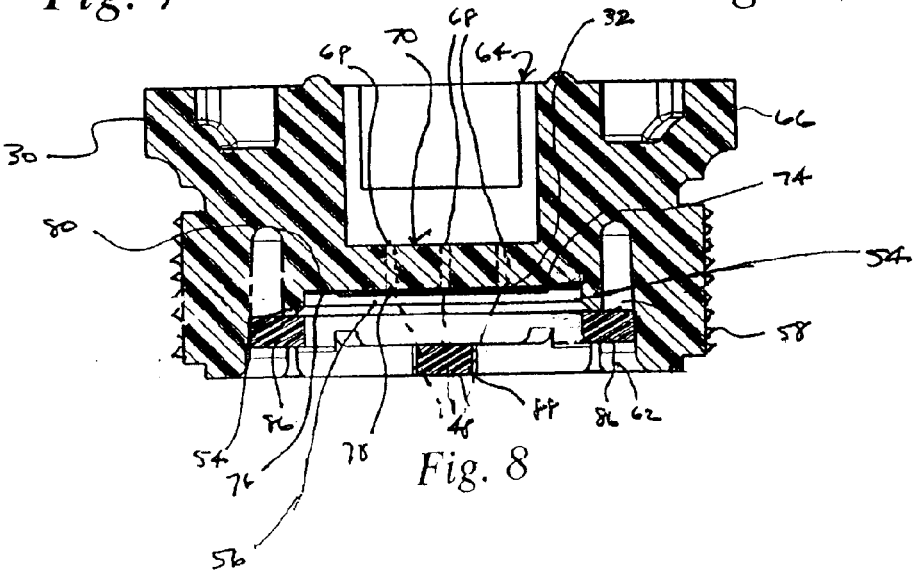
FIG. 8 is a cross-sectional view of the venting device taken at line 8—8 of FIG. 5.

Vent passages 48 are fluidly connected with the atmosphere through openings 68 in bottom 70 of key slot 64. As depicted in FIG. 7*a*, vent passages 48 are fluidly connected with the atmosphere inside drum 10 through openings 72 in inner side 50 of venting device 28. Thus, vent passages 48 extend through venting device 28 from inner side 50 to exterior side 52.

Figure 4:
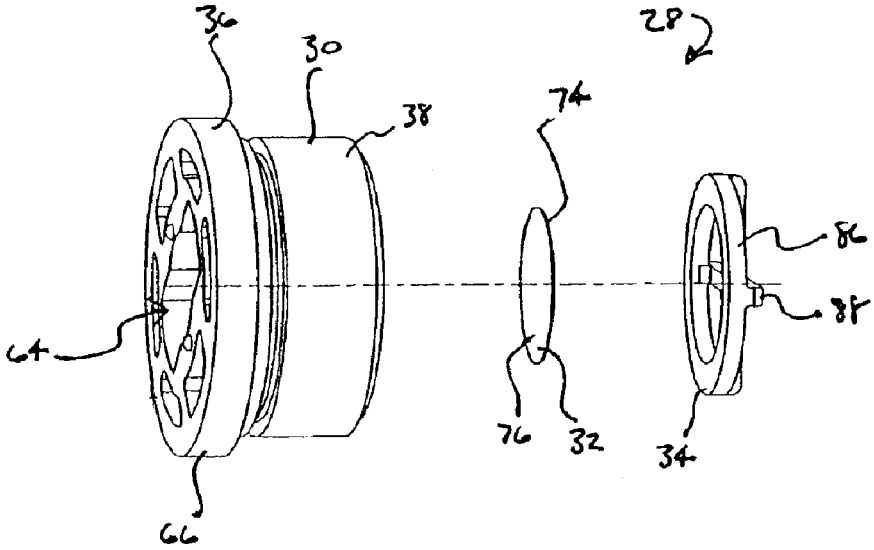
FIG. 4 is an exploded perspective view of a venting device according to the present invention from the side of the device facing the exterior of the drum.
Figure 5:
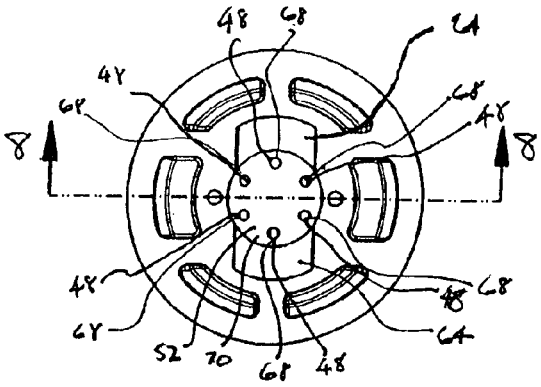
FIG. 5 is a plan view of the exterior side of the venting device.
Figure 6:
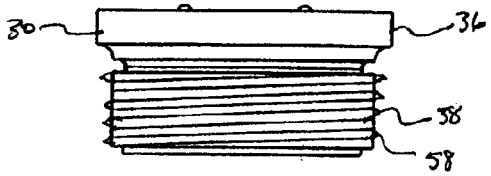
FIG. 6 is a side elevation view of the venting device.

As depicted best in the exploded views of FIGS. 3 and 4, vent membrane assembly 74 is secured to inner side 50 within recessed portion 56, covering openings 72. Vent membrane assembly 74 generally includes support backing 76 and membrane 78. Support backing 76 is typically a non-woven fabric or scrim material. In one currently preferred embodiment, vent membrane assembly 74 is formed from a laminate material available from W.L. Gore Co. under the designation #CVL-SA2. In this material, the support backing 76 is a polypropylene mesh material and membrane 78 is thin, expanded PTFE, having a pore size of approximately 0.20 micron. The thickness of membrane 78 is approximately 0.002 inch in this material. Support backing 76 provides support and strength for the thin membrane 78, and also does not unduly restrict flow of vapor or gas through the membrane due to its porous construction. The very thin, small pore, membrane offers advantages over thicker, larger pore membranes. First, the very thin dimension of the membrane provides less resistance to vapor flow than a thicker membrane. Secondly, the smaller pores are more resistant to chemical clogging than the larger pores for some types of chemicals. Of course, those of skill in the art will recognize that other thicknesses and pore sizes may also be selected for membrane 78, depending on the particular chemical or other fluid stored in the container.

Vent membrane assembly 74 is sealingly secured to inner side 50 in a sealing band 80 surrounding openings 72 of vent passages 48 and at a spot 82 on center portion 84 of inner side 50. It is currently preferred vent membrane assembly 74 be secured using heat welding in order to reduce contamination, but may also be attached by any other suitable means, such as adhesives or mechanical fasteners. Attachment of membrane assembly 74 at spot 82 secures and fixes the center of vent membrane assembly 74, offering significant advantages over prior art devices, relative to strength and durability. First, the additional attachment contact area allows force applied to membrane assembly 74 to be spread over a larger area. The result is reduced stress values at sealing band 80 during drop testing and other high load causing events. As a consequence, the likelihood that membrane assembly 74 will be torn loose or ruptured during such events is reduced. Also, the resultant overall reduction in unsupported span of vent membrane assembly 74 results in less deflection of the membrane during such conditions.

Protective structure 34 generally includes outer ring 86 and cross piece 88, which defines openings 90. Openings 90 are generally sized so that foreign objects, such as fingers or other vent plugs do not come into contact with vent membrane assembly 74. Protective structure 34 is received in recess 62 in outer shell portion 40. The increased strength of membrane assembly 74 as described above enables protective structure 34 to be placed at essentially any distance from vent membrane assembly 74 that is effective to prevent foreign objects, since protective structure 34 is not needed to support vent membrane assembly 74 as in prior art devices. It is preferred that protective structure 34 be spaced apart from vent membrane assembly 74 by at least about 0.050 inch. In the currently most preferred embodiment, protective structure 34 is spaced apart approximately 0.120 inch from vent membrane assembly 74. The open design and increased spacing of protective structure 34 from vent membrane assembly 74 is advantageous in that it promotes more thorough drain back of chemicals from vent membrane assembly 74, reducing the likelihood of coagulation or drying of chemicals in the membrane and the resultant failure of the vent.

It will be appreciated that many alternative embodiments encompassing many different structural variations for the vent device and drum or container closures are possible within the scope of the present invention. For example, venting device 28 may be an integral part of vented closure 12 or of drum 10.

What is claimed is:

1. A venting device adapted to be sealingly received in an opening of a drum, the device comprising:

a body having a pair of opposing sides and defining a plurality of vent passages, each vent passage having an opening at each of the pair of opposing sides and extending through the body, the vent passages being spaced apart and arranged around a center portion of the body;

a membrane structure covering the openings of the vent passages on one of the pair of opposing sides of the body, the membrane structure being sealingly affixed to the body portion in a sealing band surrounding the openings of the vent passages, a portion of the membrane structure being further affixed to the center portion of the body at a spot, thereby defining a portion of the membrane structure between the sealing band and the spot, the membrane structure not being attached to the body in the portion defined between the sealing band and the spot; and a protective structure attached to the body and positioned over the membrane structure.

2. The venting device of claim 1, wherein the membrane structure includes a membrane layer and a backing layer.

3. The venting device of claim 2, wherein the membrane layer comprises a fluoropolymer material.

4. The venting device of claim 3, wherein the fluoropolymer material is PTFE.

5. The venting device of claim 2, wherein the membrane layer has a thickness of about 0.002 inch.

6. The venting device of claim 1, wherein the protective structure is spaced apart from the membrane structure by at least about 0.050 inch.

7. A drum for containing a liquid, comprising:

a bottom structure, a top structure, and a wall together defining an enclosure, the enclosure having at least one bunghole defined therein; and a closure sealingly engaged in the at least one bunghole, the closure including a body portion having a pair of opposing sides and defining a plurality of vent passages, each vent passage having an opening at each of the pair of opposing sides and extending through the body, the vent passages being spaced apart and arranged around a center portion of the body, the closure further including a membrane structure covering the openings of the vent passages on one of the pair of opposing sides of the body, the membrane structure being sealingly affixed to the body portion in a sealing band surrounding the openings of the vent passages, a portion of the membrane structure being further affixed to the center portion of the body at a spot, thereby defining a portion of the membrane structure between the sealing band and the spot, the membrane structure not being attached to the body in the portion defined between the sealing band and the spot.

8. The drum of claim 7, wherein the wall is generally cylindrical.

9. The drum of claim 7, further comprising a protective structure attached to the body and positioned over the membrane structure.

10. The drum of claim 9, wherein the protective structure is spaced apart from the membrane structure by at least about 0.050 inch.

11. The drum of claim 7, wherein the membrane structure includes a membrane layer and a backing layer.

12. The drum of claim 11, wherein the membrane layer comprises a fluoropolymer material.

13. The drum of claim 12, wherein the fluoropolymer material is PTFE.

14. The drum of claim 10, wherein the membrane layer has a thickness of about 0.002 inch.

15. A venting device adapted to be sealingly received in an opening of a drum, the: device comprising:

a body having a pair of opposing sides and defining a plurality of vent passages, each vent passage having an opening at each of the pair of opposing sides and extending through the body, the vent passages being spaced apart and arranged around a center portion of the body;

membrane means covering the openings of the vent passages on one of the pair of opposing sides of the body, the membrane means being sealingly affixed to the body portion in a sealing band surrounding the openings of the vent passages, a portion of the membrane structure being further affixed to the center portion of the body at a spot, thereby defining a portion of the membrane means between the sealing band and the spot, the membrane means not being attached to the body in the portion defined between the sealing band and the spot; and protective means attached to the body and positioned over the membrane structure.

16. The venting device of claim 15, wherein the membrane means comprises a membrane structure including a membrane layer and a backing layer.

17. The venting device of claim 16, wherein the membrane layer comprises a fluoropolymer material.

18. The venting device of claim 17, wherein the fluoropolymer material is PTFE.

19. The venting device of claim 16, wherein the membrane layer has a thickness of about 0.002 inch.

20. The venting device of claim 15, wherein the protective means is spaced apart from the membrane structure by at least about 0.050 inch.

* * * * *